US008820127B2

(12) United States Patent
Avganim

(10) Patent No.: US 8,820,127 B2
(45) Date of Patent: Sep. 2, 2014

(54) LOCKING MECHANISM AND A LOCKING DEVICE COMPRISING THE SAME

(76) Inventor: Meir Avganim, Moshav Gealiya (IL)

( * ) Notice: Subject to any disclaimer, the term of this patent is extended or adjusted under 35 U.S.C. 154(b) by 0 days.

(21) Appl. No.: 13/377,318

(22) PCT Filed: Jun. 1, 2010

(86) PCT No.: PCT/IL2010/000429
§ 371 (c)(1),
(2), (4) Date: Mar. 19, 2012

(87) PCT Pub. No.: WO2010/143178
PCT Pub. Date: Dec. 16, 2010

(65) Prior Publication Data

US 2012/0160000 A1 Jun. 28, 2012

(30) Foreign Application Priority Data

Jun. 10, 2009 (IL) ..... 199267

(51) Int. Cl.
*E05B 27/04* (2006.01)
*E05B 35/04* (2006.01)

(52) U.S. Cl.
USPC ..... 70/361; 70/337; 70/375; 70/387; 70/409; 70/493

(58) Field of Classification Search
CPC ..... E05B 27/0053; E05B 35/08; E05B 35/12; E05B 27/00; E05B 27/0007; E05B 27/0014; E05B 19/0017; E05B 19/0023; E05B 27/0017; E05B 27/0021; E05B 27/0046; E05B 27/0096; E05B 19/0035; E05B 19/14
USPC ..... 70/337, 361, 387, 375, 409, 493, 495, 70/360, 462, DIG. 78, DIG. 79, DIG. 80
See application file for complete search history.

(56) References Cited

U.S. PATENT DOCUMENTS 957,938 A * 5/1910 Cox ..... 70/156
1,828,747 A * 10/1931 Perry ..... 200/43.13
(Continued)

FOREIGN PATENT DOCUMENTS

DE 24 35 149 2/1976
DE 25 32 076 7/1976
(Continued)

OTHER PUBLICATIONS

International Search Report and Written Opinion mailed Oct. 7, 2010 in corresponding PCT International Application No. PCT/IL2010/000429.

*Primary Examiner* — Lloyd Gall
(74) *Attorney, Agent, or Firm* — Ostrolenk Faber LLP

(57) ABSTRACT

A pin-tumbler locking mechanism comprising a lock-core with an elongated key slot and a series of bores arranged in a plane of the key slot for a corresponding series of driver pins of various lengths slidably received in the bores. The lock-core is normally supported in lock casing. A corresponding series of spring-supported key pins is seated in a series of bores coaxially with the driver pins so that normally at least some of the key pins are adapted to push respective driver pins to project into the key slot each by a different extent according to the respective lengths thereof; a key comprising alternately teeth and notches so that when inserted into the key slot, the driver pin ends contacting the key pins become flushed with planar surface to allow a sliding movement of the lock-core within the lock casing.

10 Claims, 13 Drawing Sheets

(56) References Cited

U.S. PATENT DOCUMENTS

| | | | | | |
|---|---|---|---|---|---|
| 2,050,696 | A | * | 8/1936 | Schoorel | 70/95 |
| 2,116,965 | A | * | 5/1938 | Schoorel et al. | 70/38 A |
| 2,322,040 | A | * | 6/1943 | Maruri | 70/145 |
| 2,480,481 | A | | 8/1949 | Kelly | 70/227 |
| 3,455,128 | A | * | 7/1969 | Tenkoff | 70/361 |
| 3,969,915 | A | * | 7/1976 | Droske | 70/492 |
| 4,376,381 | A | * | 3/1983 | Muus | 70/337 |
| 5,469,723 | A | * | 11/1995 | Litwin et al. | 70/107 |
| 5,606,881 | A | * | 3/1997 | Drake | 70/352 |
| 6,701,761 | B1 | * | 3/2004 | Chang et al. | 70/337 |
| 2009/0301149 | A1 | * | 12/2009 | Widen | 70/358 |

FOREIGN PATENT DOCUMENTS

| | | |
|---|---|---|
| FR | 898 459 | 4/1945 |
| FR | 1 010 520 | 6/1952 |
| FR | 1 196 802 | 11/1959 |
| FR | 2 530 715 | 1/1984 |
| GB | 430 168 | 6/1935 |

* cited by examiner

LOCKING MECHANISM AND A LOCKING DEVICE COMPRISING THE SAME

CROSS-REFERENCE TO RELATED APPLICATIONS

The present application is a 35 U.S.C. §§371 national phase conversion of PCT/IL2010/000429, filed Jun. 1, 2010, which claims priority of Israeli Patent Application No. 199267, filed Jun. 10, 2009. The PCT International Application was published in the English language.

FIELD OF THE INVENTION

The present invention generally relates to locks, and specifically to locking mechanisms and locking devices used for doors, gates, and the like.

BACKGROUND OF THE INVENTION

Locking devices for doors and gates are well known in the art. Many of these devices frequently comprise a cylinder lock and a locking bolt in a same housing, the lock generally adapted to move the locking bolt between a locked position (door is locked) and an unlocked position (door is unlocked).

A conventional cylinder lock generally comprises a cylindrical core inserted in a cylindrical hole inside a casing, the cylindrical core adapted to rotate inside the hole when a correct key is inserted in a key slot in the core. Typically, prior to insertion of the key, the cylindrical core is in a closed position with the locking bolt in the locked position. Insertion of the correct key and rotation of the cylindrical core to an open position causes the locking bolt to move into the unlocked position.

The cylindrical core generally comprises a plurality of vertical "key-pin" holes (typically 5 or 6 holes although more or less holes may be used) disposed along a portion of the length of the cylindrical core, and into which are inserted "key" pins of varying lengths. The key pins are generally rounded at an end to allow the key to slide over them with relative ease when inserted and/or removed from the key slot.

Vertically positioned in "driver-pin" holes in the casing and above (or below) the key pins are spring-loaded "driver" pins. Each driver pin generally corresponds to a key pin below it, and is adapted to be pushed downwards into the key-pin hole of the key pin preventing the cylindrical core from rotating when there is no key in the key slot. Occasionally, the number of driver pins may be greater than the number of key pins, as typically used in "mastered" locks (one key opens several locks). A locking mechanism as described is generally known as a "pin tumbler locking mechanism". This type of locking mechanism is based on a misalignment in a shear line along a point of intersection of the cylindrical core and the casing when an incorrect key is inserted in the key slot (that is, the shape of the key when inserted into the key slot causes one or more of the driver pins to be pushed into the key-pin hole of the key pin below it, and/or causes one or more key pins to be pushed into the driver-pin hole of the driver pin above it) and the cylindrical core may not be rotated. When the correct key is inserted in the key slot, the key pins and the driver pins are positioned inside their respective key-pin holes and driver-pin holes so that the shear line is aligned and the cylindrical core may be rotated to an open position.

A drawback in conventional cylinder locks is that they generally occupy a relatively large portion of a door area so as to provide space for rotation of the cylinder core. Additionally, space may also be required to accommodate a transmission mechanism, such as for example a cam, adapted to translate rotational motion of the cylindrical core into linear motion of a bar which secures and releases the locking bolt. Occasionally, a problem may arise in applications where the door area available to the locking device is restricted and which may limit the use of the conventional cylinder locks.

It is therefore the prime object of the invention to overcome this drawback of conventional cylinder locks.

It is a further object of the invention to provide a novel locking device which provides similar locking characteristics as those of conventional cylinder locks yet occupies a smaller door area than that occupied by the cylinder locks.

It is still a further object of the invention to provide for a locking device wherein a pin-tumbler locking arrangement is used as part of the locking mechanism however operable by a longitudinal rather than rotational movement.

SUMMARY OF THE INVENTION

Provided according to the invention is a pin-tumbler locking mechanism comprising a lock-core with an elongated key slot and a series of bores arranged in a plane of the key slot; a corresponding series of driver pins of various lengths slidably received in the bores; a lock-core casing movably supporting the lock-core, the interface between the lock-core and the lock casing defining a planar surface; a first series of spring-supported key pins seated in a series of bores coaxially with the said driver pins so that normally at least some of the key pins extend beyond the planar surface, being in contact and adapted to push the driver pins to project into the key slot each by a different extent according to the respective lengths thereon; a first key comprising alternately teeth and notches so that when inserted into the key slot the driver pin ends contacting the key pins become flushed with the planar surface to allow said movement of the lock-core; and wherein the lock-core is of a prismatic shape and said movement is a sliding movement.

Provided according to a still further aspect of the invention is a locking device for a door or a gate, the locking device comprising a pin-tumbler locking mechanism comprising a lock-core with an elongated key slot and a series of bores arranged in a plane of the key slot; a corresponding series of driver pins of various lengths slidably received in the bores; a lock-core casing movably supporting the lock-core, the interface between the lock-core and the lock casing defining a planar surface; a corresponding series of spring-supported key pins seated in a series of bores coaxially with the said driver pins so that normally at least some of the key pins extend beyond the planar surface, being in contact and adapted to push the driver pins to project into the key slot each by a different extent according to the respective lengths thereon; a first key comprising alternately teeth and notches so that when inserted into the key slot the driver pin ends contacting the key pins become flushed with the planar surface to allow said movement of the lock-core; and wherein the lock-core is of a prismatic shape and said movement is a sliding movement; a lock housing; and a locking bolt.

Provided according to a still further aspect of the invention is a door or a gate comprising a locking device for a door or a gate, the locking device comprising a pin-tumbler locking mechanism comprising a lock-core with an elongated key slot and a series of bores arranged in a plane of the key slot; a corresponding series of driver pins of various lengths slidably received in the bores; a lock-core casing movably supporting the lock-core, the interface between the lock-core and the lock casing defining a planar surface; a corresponding series of spring-supported key pins seated in a series of bores coaxially with the said driver pins so that normally at least some of the key pins extend beyond the planar surface, being in contact and adapted to push the driver pins to project into the key slot each by a different extent according to the respective lengths thereon; a first key comprising alternately teeth and notches so that when inserted into the key slot the driver pin ends contacting the key pins become flushed with the planar surface to allow said movement of the lock-core, wherein the lock-core is of a prismatic shape and said movement is a sliding movement; a lock housing; and a locking bolt. In some embodiments, the locking of the mechanism is attained by sliding the lock-core by the key a pre-set distance ("the core locked position"), and withdrawing the key from the key slot in the locked position. Optionally, there are provided an additional series of key pins in line with the first series, whereby in the locked position at least some of the first series of driver pins become aligned with the key pins of the second series. Optionally, the ends of the first series of driver pins are pushed into the key slot by the second series of key pins when the key is withdrawn from the key slot.

In some embodiments, the mechanism further comprises a second key, wherein the unlocking of the mechanism is attained by inserting the second key into the key slot and pulling the lock-core by the key away from the core locked position and withdrawing the key from the key slot ("the unlocked core position"). Optionally, the mechanism further comprises means associated with at least one of the first series of the key pins for preventing the projection thereof beyond the said planar surface. Optionally, the at least one key pin comprise the first-in-line of the said first key pin series. Additionally or alternatively, the at least one key pin comprise the first and the second-in-line of the said first key pin series.

In some embodiments, the first and second keys are symmetrical. Optionally, the first and second keys are symmetrical but for one said teeth and notches. Optionally, the first-in-line tooth of the second key is removed. Additionally or alternatively, the teeth and notches of the first key and the teeth and notches of the second key are applied to one and the same key, each at one side thereof.

In some embodiments, the lock-core is coupled to a lock operator for applying a reciprocal locking and unlocking movement to a locking device bolt.

Further provided according to the invention is a method for operating a pin-tumbler mechanism, the method comprising arranging a series of bores in a plane of an elongated key slot in a lock-core; slidably inserting a corresponding series of driver pins of various lengths into the bores; movably supporting the lock-core with a lock-core casing and interfacing between the lock-core and the lock casing with a planar surface; seating a corresponding series of spring-supported key pins in a series of bores coaxially with the said driver pin and extending the key pins beyond the planar surface so as to contact and push the driver pins to project into the key slot each by a different extent according to the respective lengths thereon; allowing a sliding movement in a prismatic shaped lock-core by inserting into the key slot a first key comprising alternately teeth and notches and flushing the driver pin ends contacting the key pins with the planar surface.

BRIEF DESCRIPTION OF THE DRAWINGS

These and additional constructional features and advantages of the invention will become more clearly understood in the light of the following description of several preferred embodiments thereof given by way of example only, with reference to the attached drawings, wherein—

DETAILED DESCRIPTION OF THE PREFERRED EMBODIMENTS

Figure 1:
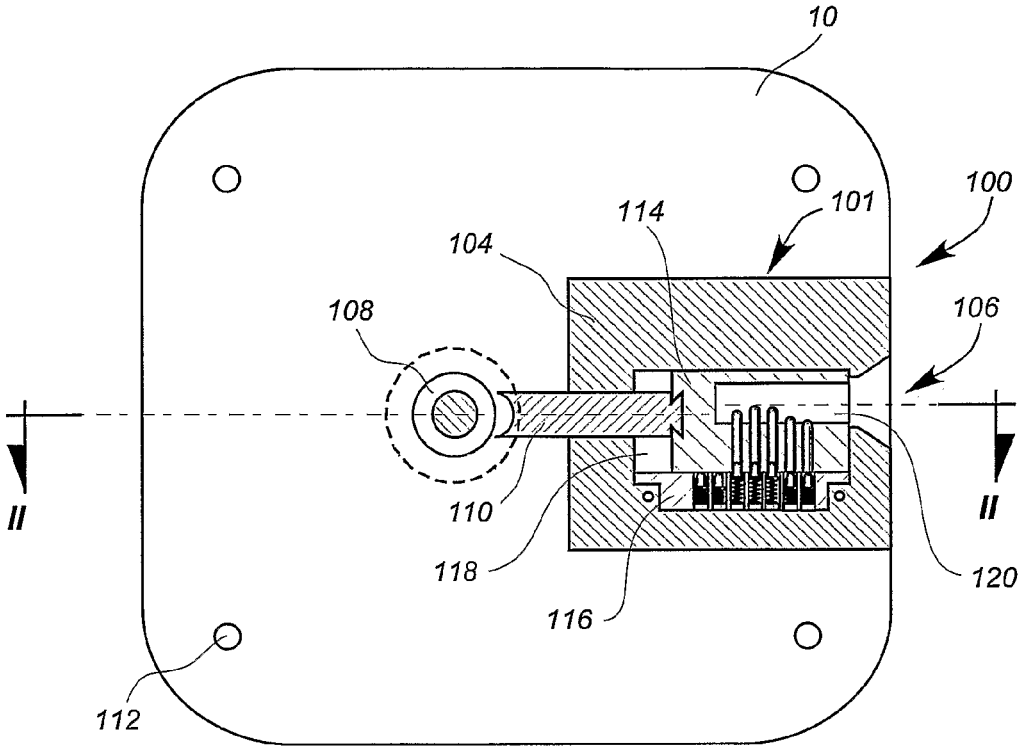
FIG. 1 is a planar, partly cross-sectional view of a locking device including an exemplary locking mechanism in an open lock position, according to a preferred embodiment of the present invention.
Figure 2:
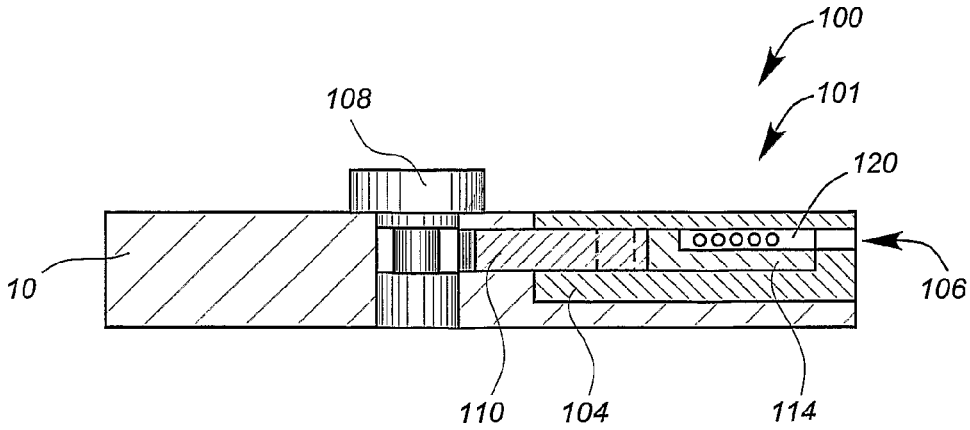
FIG. 2 is a section II-II of the locking mechanism of FIG. 1.

Reference is made to FIG. 1 which schematically illustrates a cross-sectional plan view of a door mounting plate 10 comprising an exemplary locking device 100 including an exemplary locking mechanism 101 in an open lock position, and to FIG. 2 which is a section II-II of FIG. 1.

Mounting plate 10 may be fastened to any type of door known in the art, or any other lockable item such as vaulet, safe or suitcase wherein the use of a regular tumbler-pin locking mechanism is unsuitable due to insufficient wall width or other reasons.

The locking/unlocking of the device 100 is described for the purposes of illustration as applied to a locking button 108 which, in the unlocked position is retractable from the surface of the plate 10. Obviously other arrangements may be chosen such as arms, levers, cam, rotors and the like for effecting the locking/unlocking operation.

There is provided a pin-tumbler mechanism 120 adapted to be operated by slidingly pushing/pulling a prismatic shaped lock-core 114 coupled to a bar 110, from an open position (unlocked position) to a closed position, and further adapted to be unlocked by slidingly pulling the lock core 114 from the closed position to the open position. This contrasts with other pin-tumbler mechanisms known in the art which involve rotating a cylinder core.

Reference shall now be made to FIGS. 3A-3F which schematically illustrate on an enlarged scale the locking mechanism 101 operated from an open position to a closed position.

Lock casing 104 includes a prismatic chamber 118 bordered by at-least front wall 121, rear wall 119, and a planar surface (shear-line surface) 117 extending from the front wall to the rear wall. The lock-core 114 is seated inside chamber 118 and adapted to slide longitudinally along shear-line surface 117 between front wall 121 and rear wall 119 along with the lock bar 110 which is slidingly supported within a slot 115.

Sliding core 114 towards the open position, from rear wall 119 towards front wall 121, pulls bar 110 through slot 115 away from locking button 108, releasing the bolt.

Casing 104 includes a series of spring-supported key pins seated inside a series of bores, for example seven key pins 151-157 freely seated inside seven key-pin holes (bores) 151H-157H, the key-pin holes being linearly deployed along shear-line surface 117 between front wall 121 and rear wall 119. Optionally, key-pin holes 151H-157H are arranged on shear-line surface 117 in a plurality of lines. Optionally, key pins 151-157 and key-pin holes 151H-157H are comprised in a modular pin unit (not shown), the unit adapted to be attached to casing 104 to form a part of the casing.

Key pins 153-157 are spring-loaded and are adapted to extend from key-pin holes 153H-157H beyond shear-line surface 117 when not subject to an opposing force (a force applied from the key slot—see below). In contrary, key pins 151 and 152, are normally flushed with shear-line surface 117 even when not subject to an opposing force namely always blocked from projecting beyond the shear-line 117, but allowed to retract into their respective holes 151H and 152H.

Hence, when subject to an opposing force, all pins 151-157 are adapted to retract into key-pin holes 151H-157H, as-well-as becoming flush with shear-line surface 117.

Lock-core 114 includes a key slot 120 adapted to receive a key 126; and a series of driver pins of various lengths (see bellow) slidably received inside a series of driver-pin holes (bores), for example driver pins 161-165 inside five driver-pin holes 161H-165H (see FIG. 3D), the driver-pin holes arranged in a plane of the key slot.

Figure 3A:
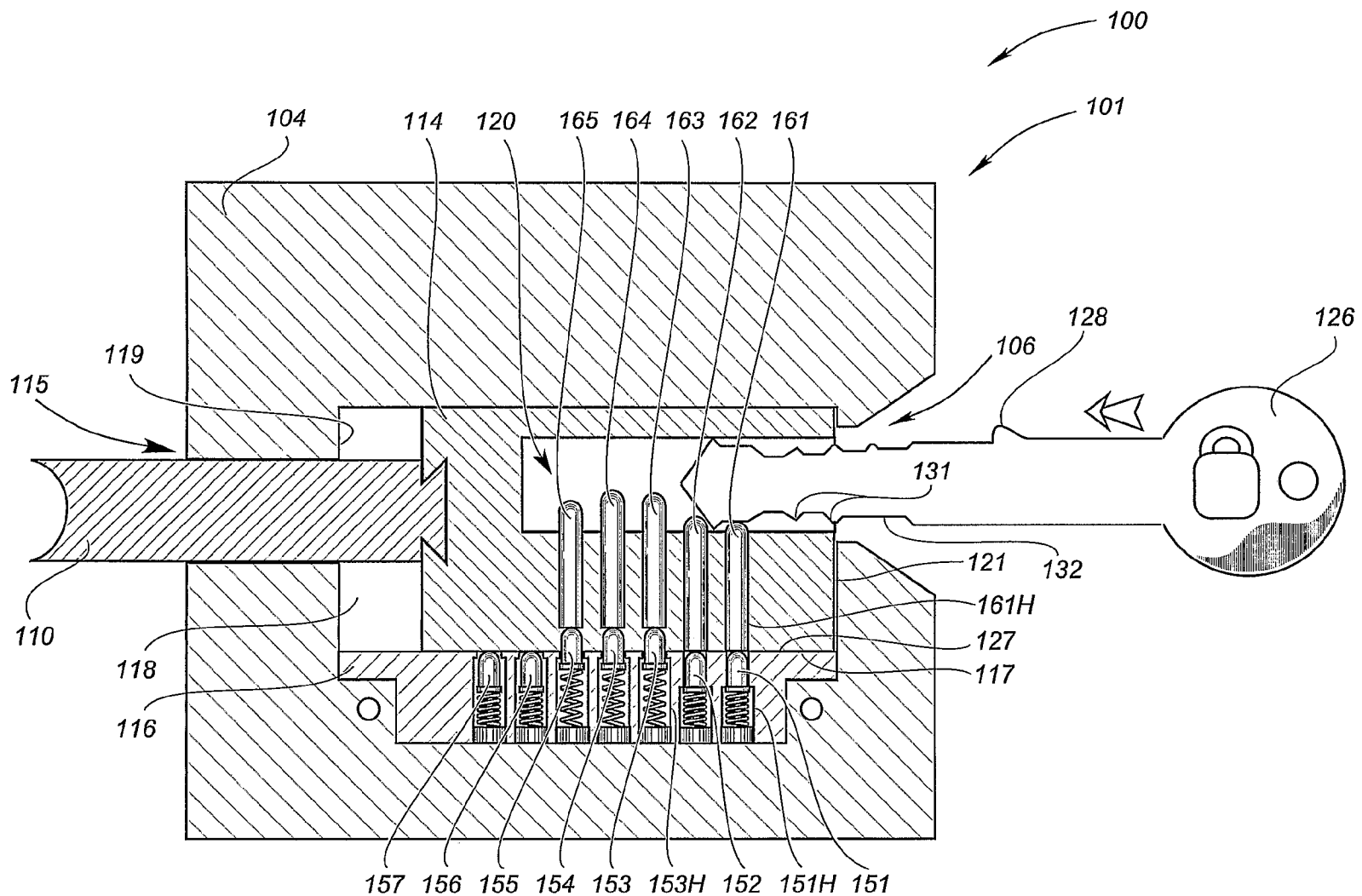
FIGS. 3A-3F and 4 illustrate successive stages of operations of the locking mechanism of FIG. 1 from an open position to a locked position thereof.
Figure 3B:
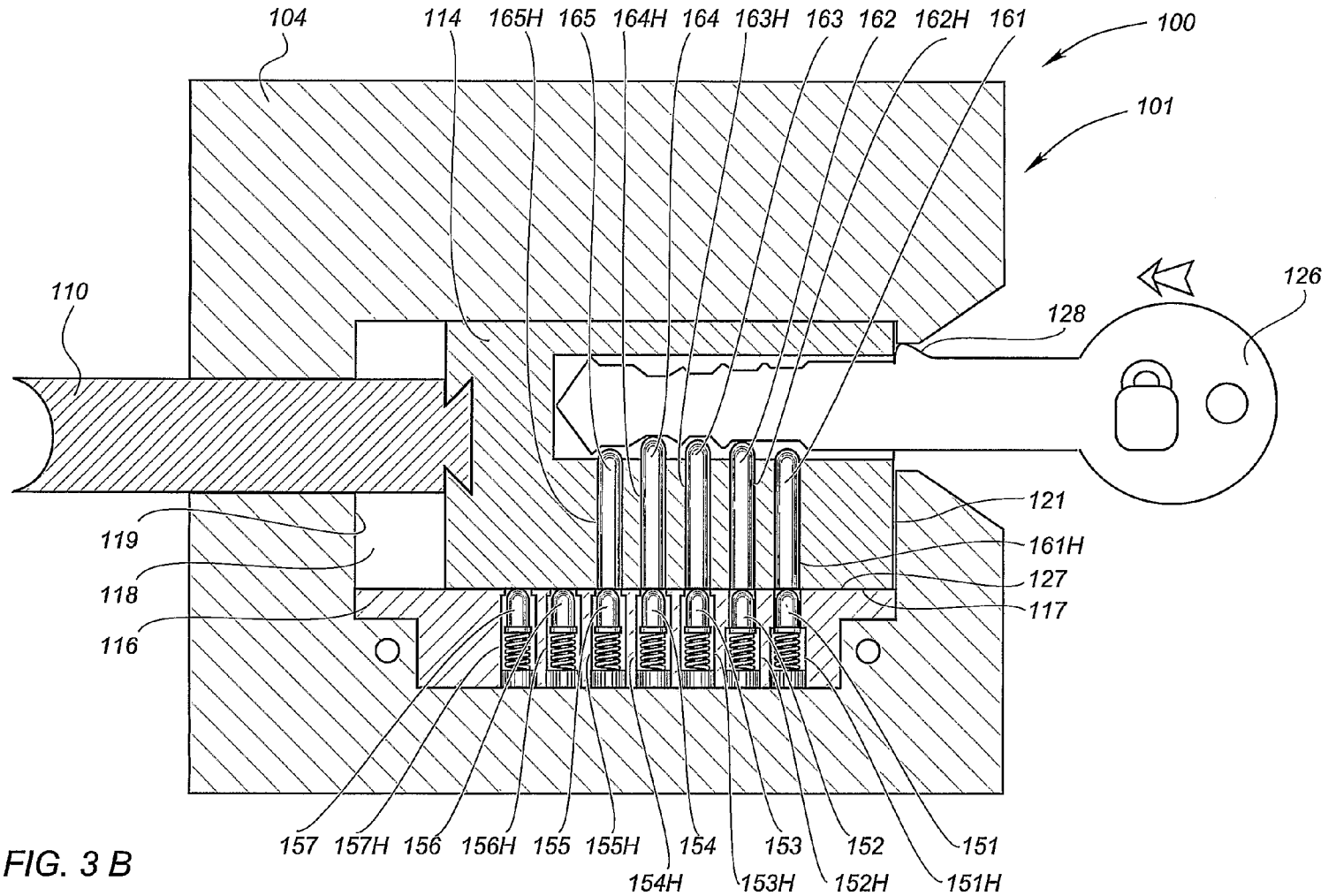
Figure 3C:
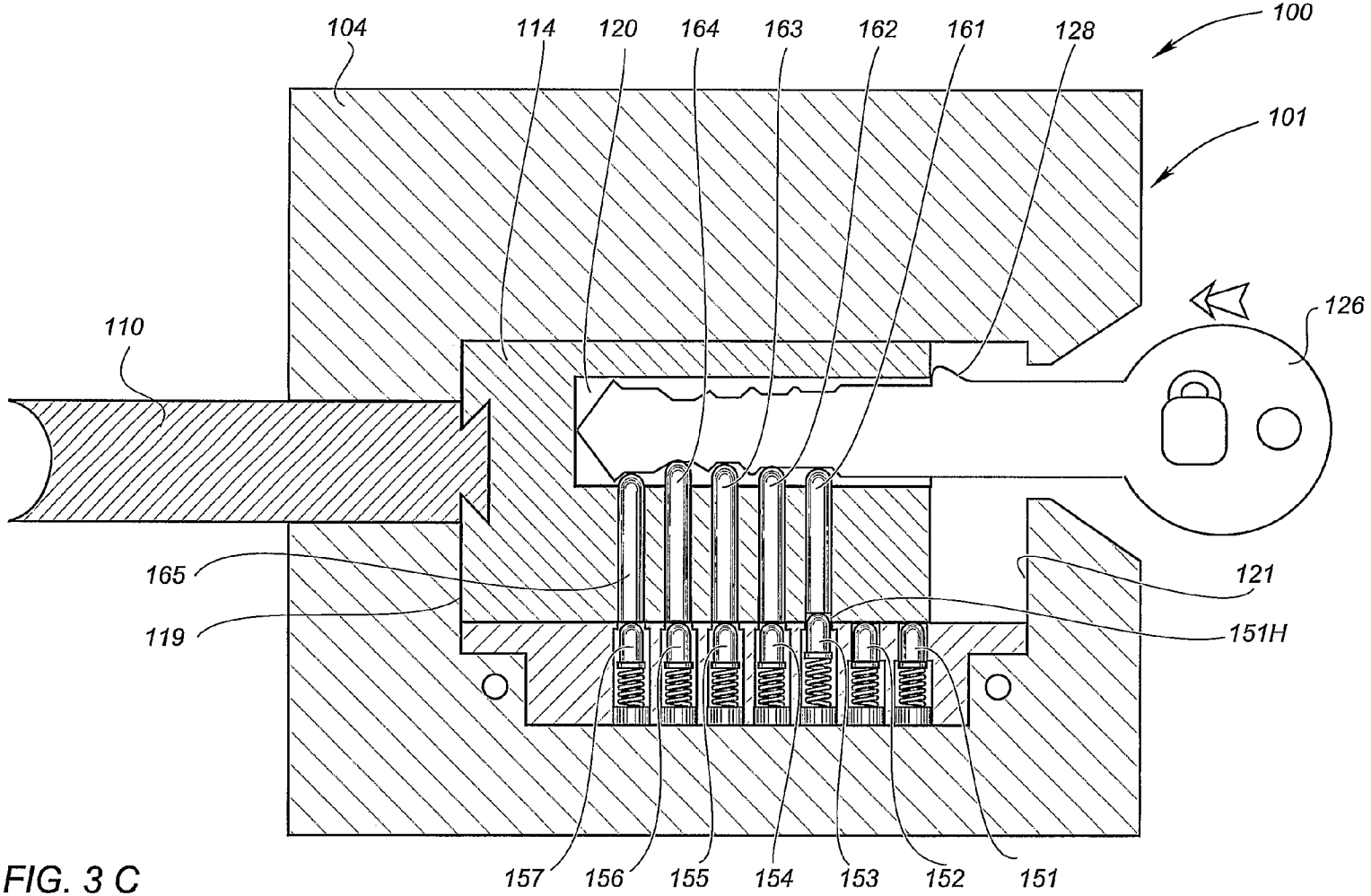

Key 126 is inserted into key slot 120 through a keyhole 106 extending from a front section of casing 104 to front wall 121. Driver-pin holes 161H-165H extend from a sliding surface 127 at an interface of core 114 along shear-line surface 117 up to a second end inside key slot 120. Driver-pin holes 161H-165H are positioned along sliding surface 127 such that each driver-pin hole is coaxially aligned with a first series of key-pin holes comprising key-pin holes 151H-155H, respectively, when core 114 is in the open position (FIGS. 3A, 3B). Driver-pin holes 161H-165H are further positioned along sliding surface 127 such that each driver-pin hole is coaxially aligned with a second series of key-pin holes, which may include one or more key-pin holes from the first series, and includes key-pin holes 153H-157H, respectively, when core 114 is in the closed position (FIG. 3C). When coaxially aligned, a center of a circular cross-section of a key-pin hole and a center of a circular cross-section of a driver-pin hole are aligned along a same axis.

Driver pins 161-165 are of varying lengths (one or more pins may be of a same length), adapted to project into key slot 120 by the spring loaded key pins 151-157. Driver pins 161-165 project into key slot 120 by a different extent according to their respective lengths. Driver pins 161-165 are further adapted to retract into driver-pin holes 161H-165H when key 126 is inserted into key slot 120, teeth 131 and notches 132 (FIG. 3A) pushing down on driver pins 161-165 until all ends thereof, contacting the respective key pins 151-155 align (becomes flushed) with shear-line surface 117 (an end of each key pin 151-157 also aligns with shear-line surface 117). Alignment of driver pins 161-165 (and key pins 151-157) with shear-line surface 117 allows for core 114 to slide on shear-line surface 117 between front wall 121 and rear wall 119. Driver pins 161-165 are additionally adapted to not align with shear-line surface 117 when an incorrect key is inserted (or no key is inserted).

Figure 3D:
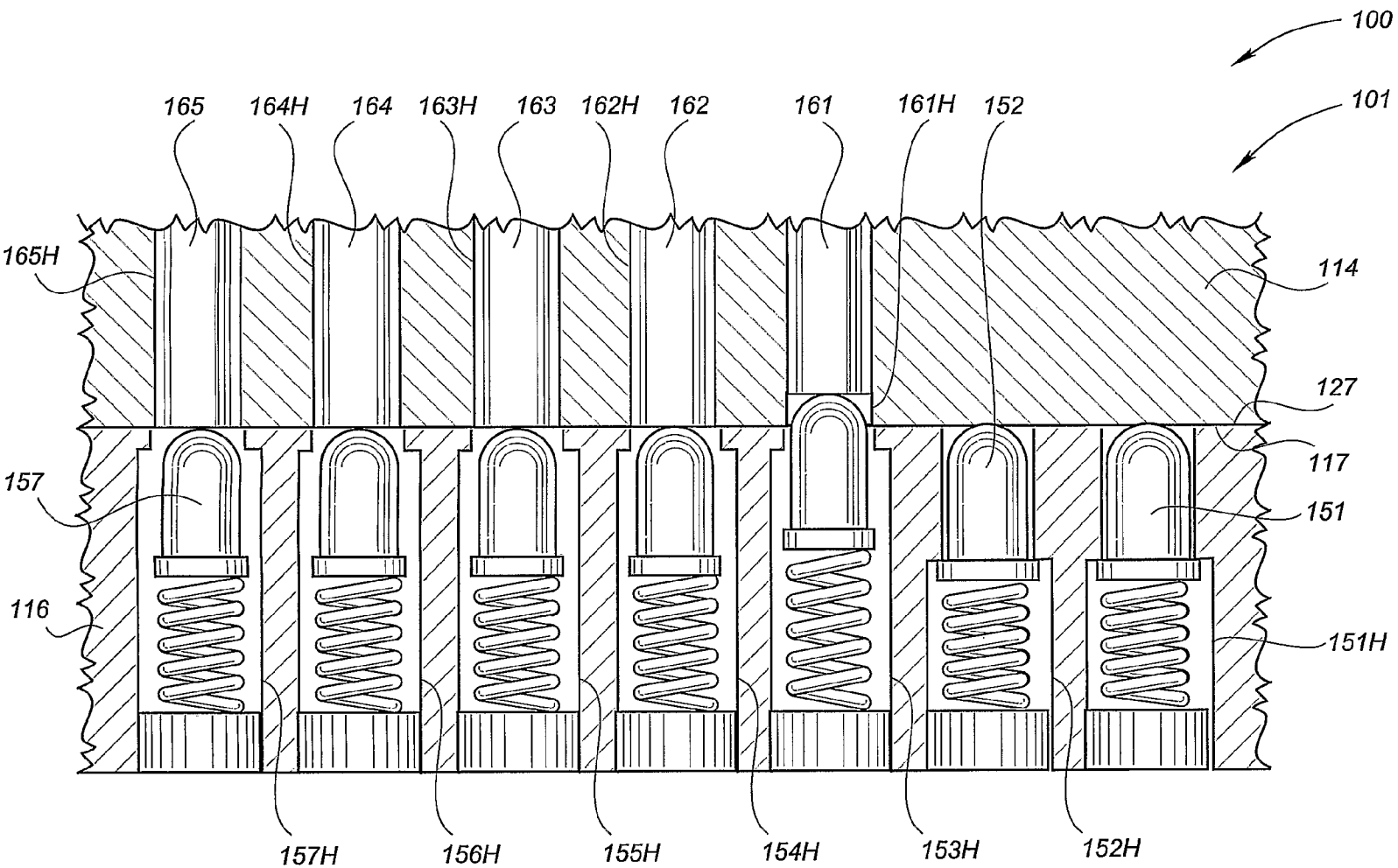

In FIG. 3A locking mechanism 101 is shown in an open position with key 126 partly inserted in key slot 120. In the open position, core 114 abuts front wall 121, bar 110 receded into chamber 118 through slot 115, locking button 108 being released. Key-pin holes 151H-155H are coaxially aligned with driver-pin holes 161H-165H, so that a first series of key pins 151-155 contact and push the respective drive pins to project into key slot 120. Three key pins 153-155 extend from key-pin holes 153H-155H, respectively, into driver-pin holes 163H-165H effectively locking core 114 in place (the core remains stationary). Two key-pins 151 and 152 are flushed with shear-line surface 117, key-pin holes 151H and 152H comprising means (blocking shoulders) for preventing the projection of the key pins beyond the shear-line surface. Optionally, key-pin hole 151H or 152H are stepped for preventing the projection of key pin 151 or 152 beyond shear-line surface 117 by said shoulders as best seen in FIG. 3D. The length of driver pins 161 and 162 are such that an end of each driver pin projects into key slot 120 when key pins 151 and 152 are in their normal position, namely flushed with shear-line 117.

In a locking operation, key 126 is inserted through keyhole 106 into key slot 120. In a preferred embodiment, key 126 is a double sided key (see bellow), one side alternately comprising teeth 131 adapted to push downwards on driver pins 161-165 as the key advances into key slot 120 (and removed from the key slot), and notches 132, each notch associated with a particular driver pin, and adapted to act on the driver pins and position them into alignment with shear-line surface 117. Driver pins 161-165 do not alter the position of key pins 151-155 which remain in alignment with shear-line surface 117.

FIG. 3B shows locking mechanism 101 still in the open position, with key 126 fully inserted in key slot 120. A knob or pawl 128 in key 126 abuts a front section of core 114, the knob adapted to push the core from front wall 121 to rear wall 119 when moving the core to the closed position. As seen in the figure, first series driver pins 161-165 have been positioned into alignment with shear-line surface 117 by their respective (associated) notches 132. First series key pins 151-155 are also retracted into alignment with shear-line surface 117. Core 114 can then be slid along shear-line surface 117 from abutting front wall 121 (open position) to abutting rear wall 119 (closed position) while key pins 151-155 and driver pins 161-165 remain aligned with shear-line surface 117.

In FIG. 3C locking mechanism 101 is shown in the closed position namely after driving the core 114 fully home. (Core 114 abuts rear wall 119, bar 110 extends through slot 115 securing locking button 108 (FIG. 1).)

Four driver pins 162-165, and four key pins 154-157, are aligned along shear-line surface 117. Two key pins 151 and 152 remain inside key-pin holes 151H and 152H, respectively (as previously discussed, these holes include means to prevent the key pins from projecting outwards). Key pin 153 protrudes from key-pin hole 153H into driver-pin hole 161H pushing driver pin 161 into key slot 120 and to abutment with a notch 132 in key 126. The extension of key pin 153 into driver-pin hole 161H effectively locks core 114 in place (the core remains stationary) while key 126 is retracted from key slot 120 (see FIG. 3D).

Figure 3E:
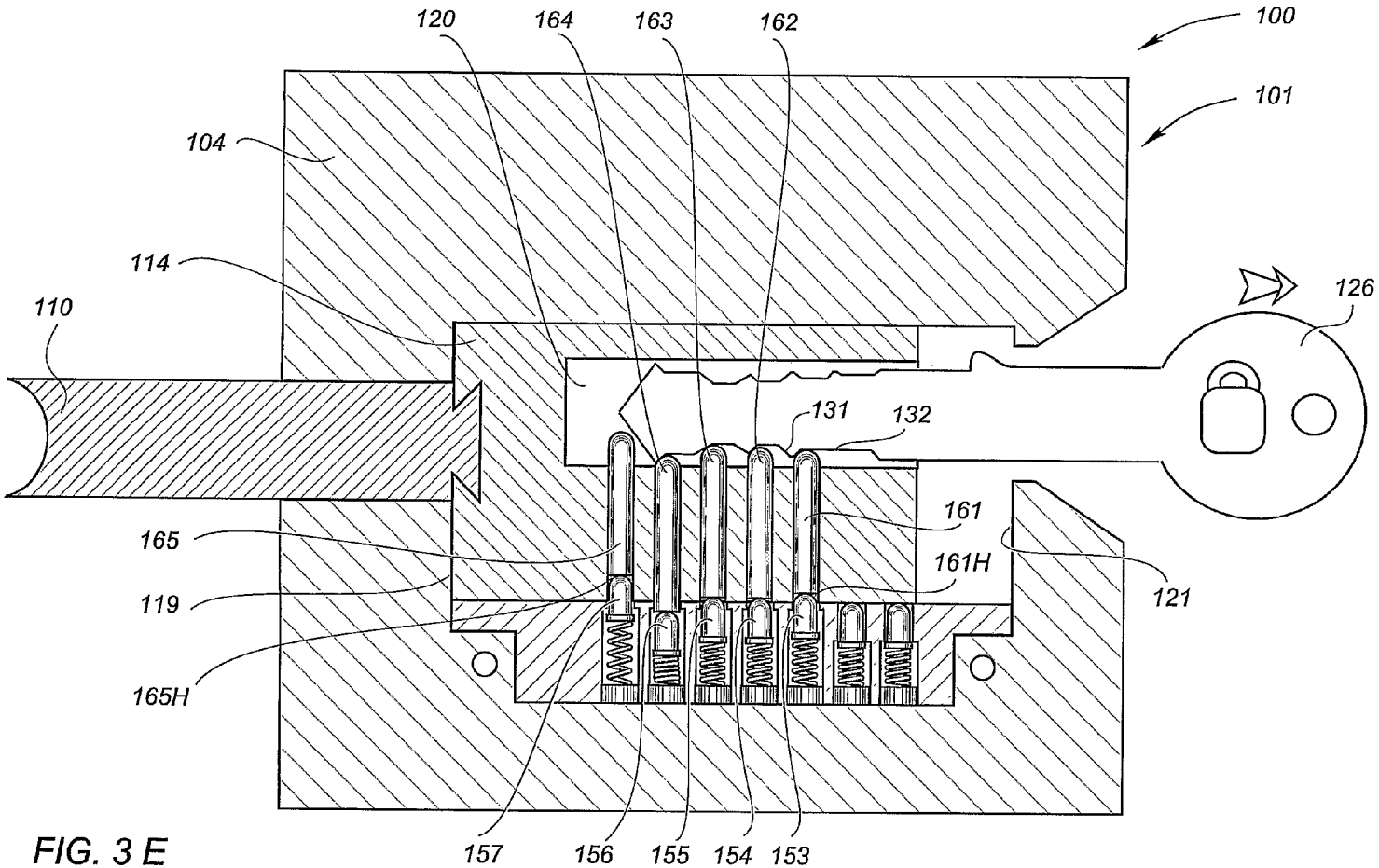
Figure 3F:
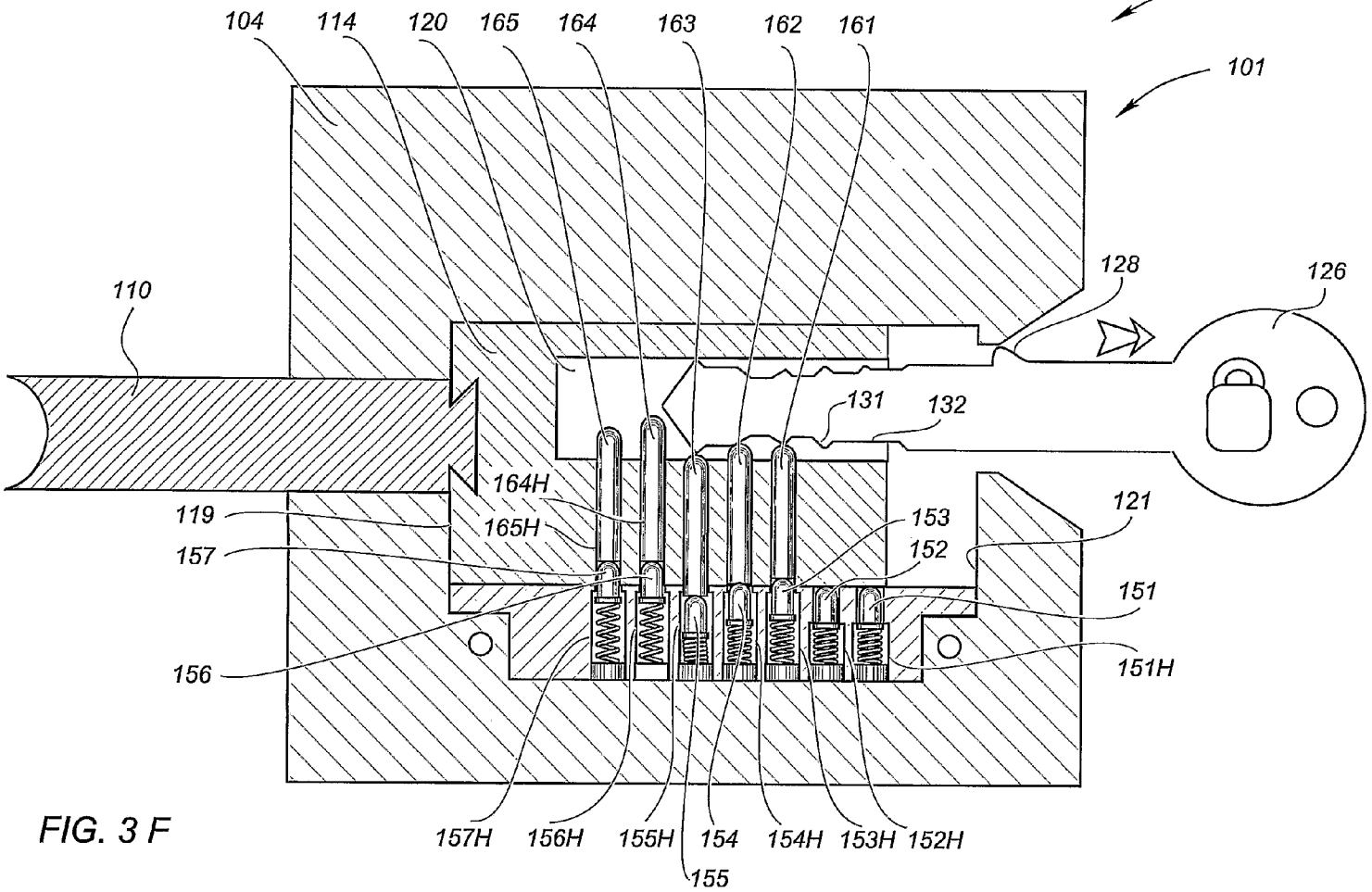

FIGS. 3E and 3F show key 126 partially withdrawn (each figure shows a different stage of withdrawal) from key slot 120 while core 114 is in the closed position. As key 126 is withdrawn, driver pins 165, 164, 163 and 162 become gradually relieved to project into the key slot; driver pin 161 remains in its projected position. Once the key 126 is fully removed, the projection of key-pins 153-157 into driver-pin holes 161H-165H locks core 114 in the inserted position, and lock button 108 is engaged by bar 110 as shown in FIG. 4.

As already mentioned, the key 126 further comprises a second series of teeth 133 and notches 130 the function of which shall now be discussed with reference to FIGS. 5A-5D illustrating the unlocking operation, namely shifting the core 114 into the open position of FIG. 1.

Figure 4:
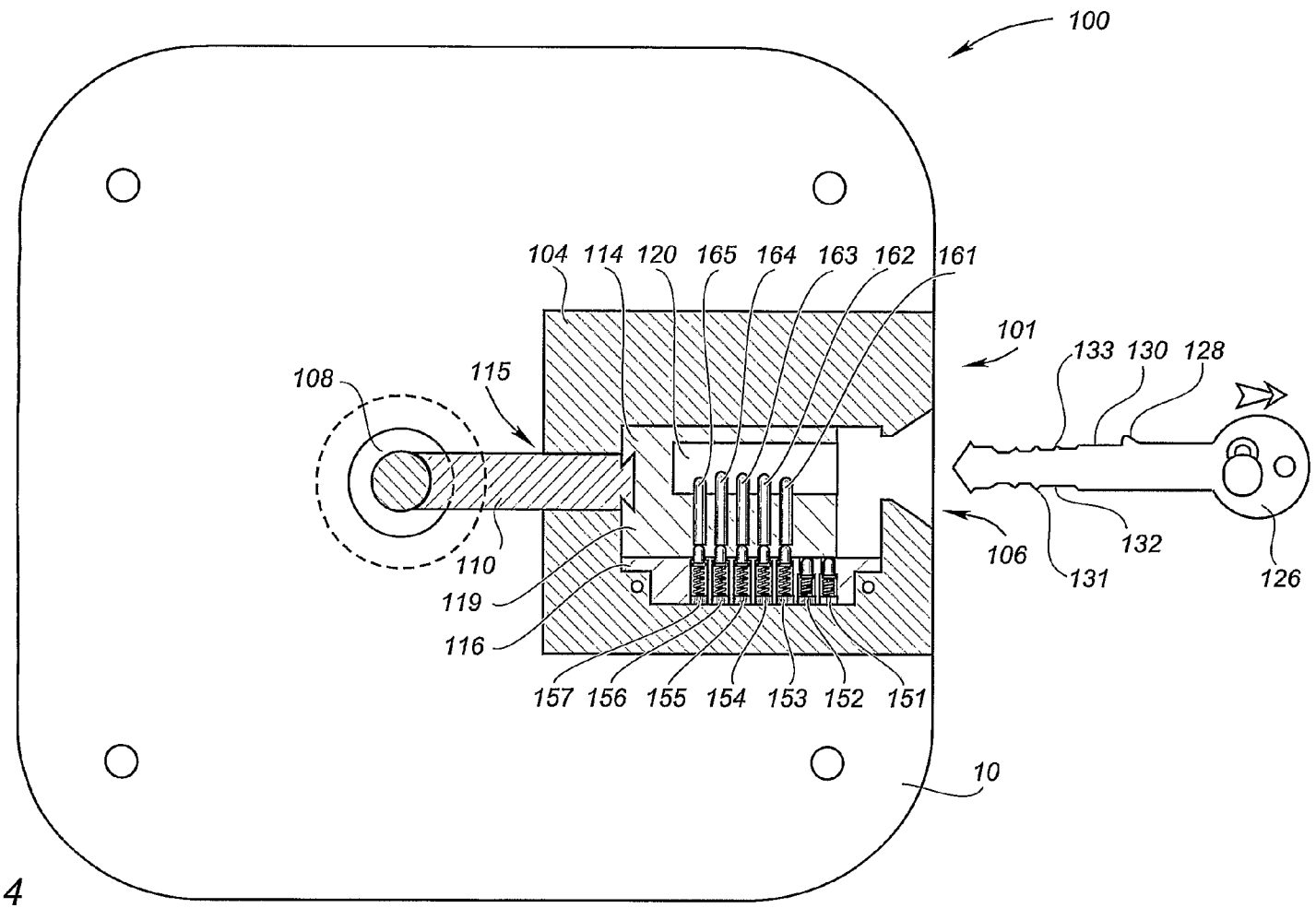
Figure 5A:
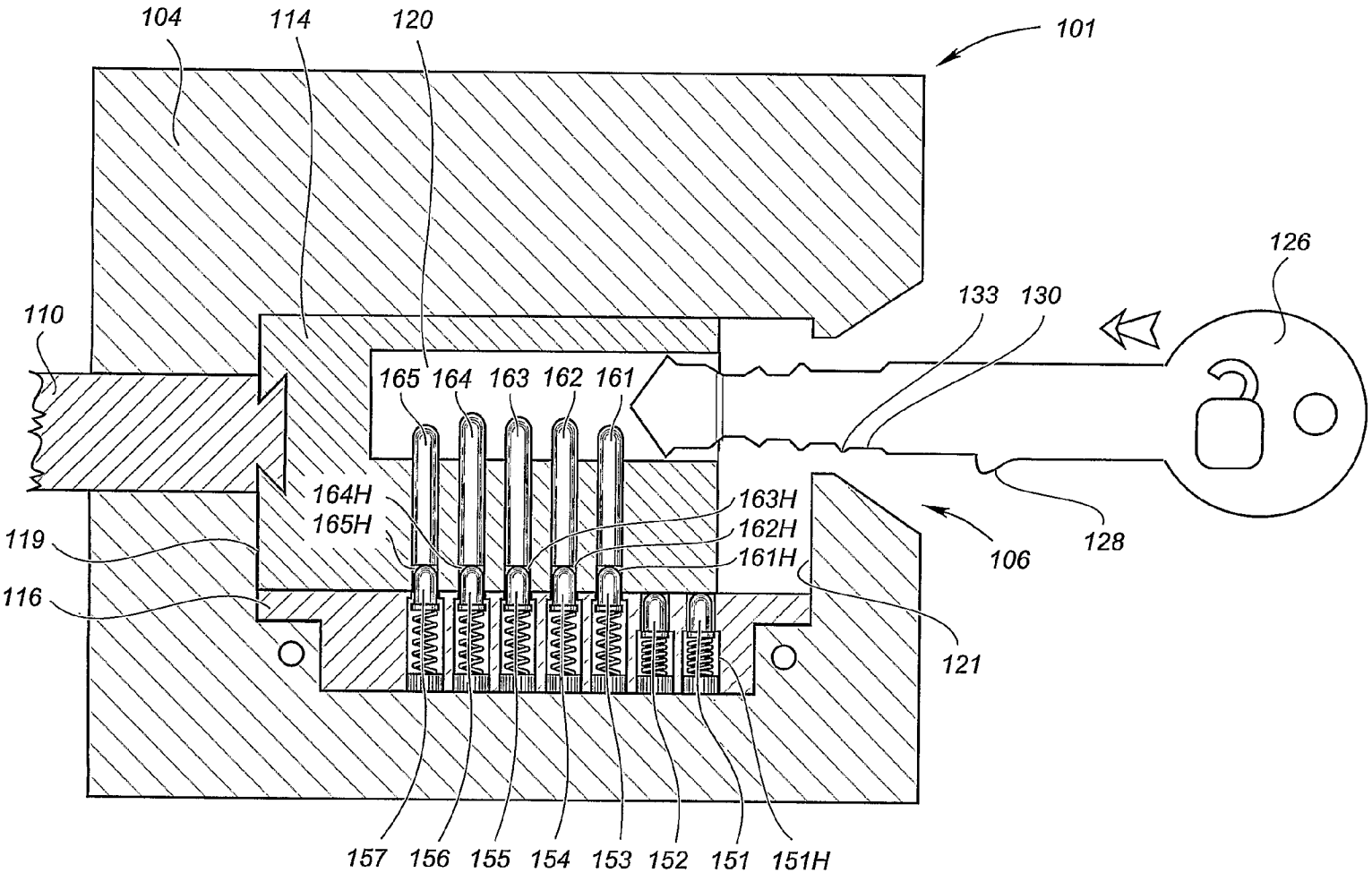
FIGS. 5A-5D illustrate successive stages of operations of the locking mechanism of FIG. 1 from a locked position to an open position thereof.

In FIG. 5A, as also shown in FIG. 4, second series key pins 153-157 project into driver-pin holes 161H-165H, pushing driver pins 161-165 into key slot 120, and locking core 114 in place (in the closed position—core locked position). Two first series key pins 151 and 152 are shown aligned with shear-line surface 117.

Key 126 is inverted, so that teeth 133 and notches 130 may act on driver pins 161-165, and pushed through keyhole 106 into key slot 120.

Obviously, another key with a set of teeth and notches substantially the same to teeth 133 and notches 130 in key 126 can be used.

Figure 5B:
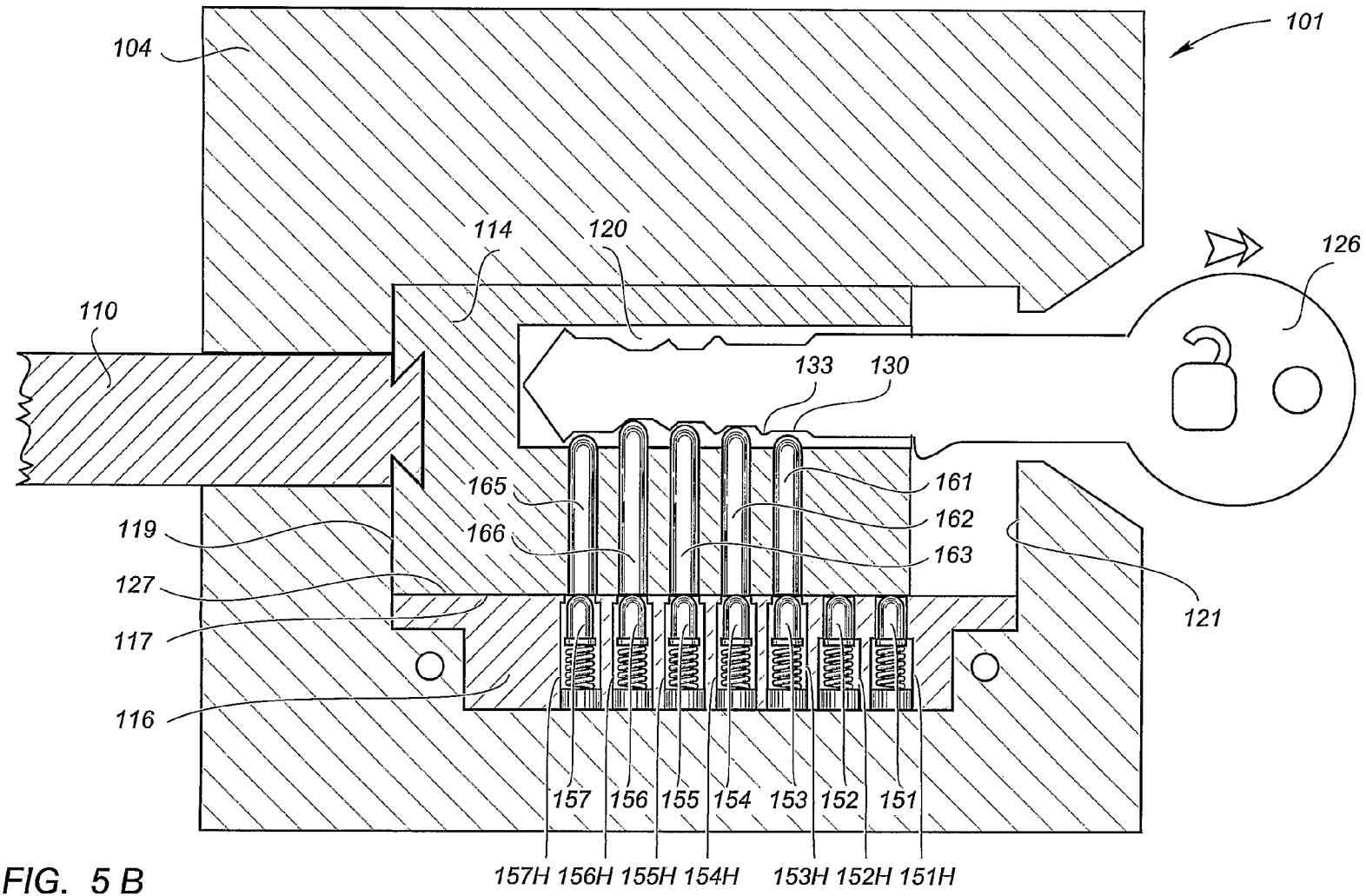
Figure 5C:
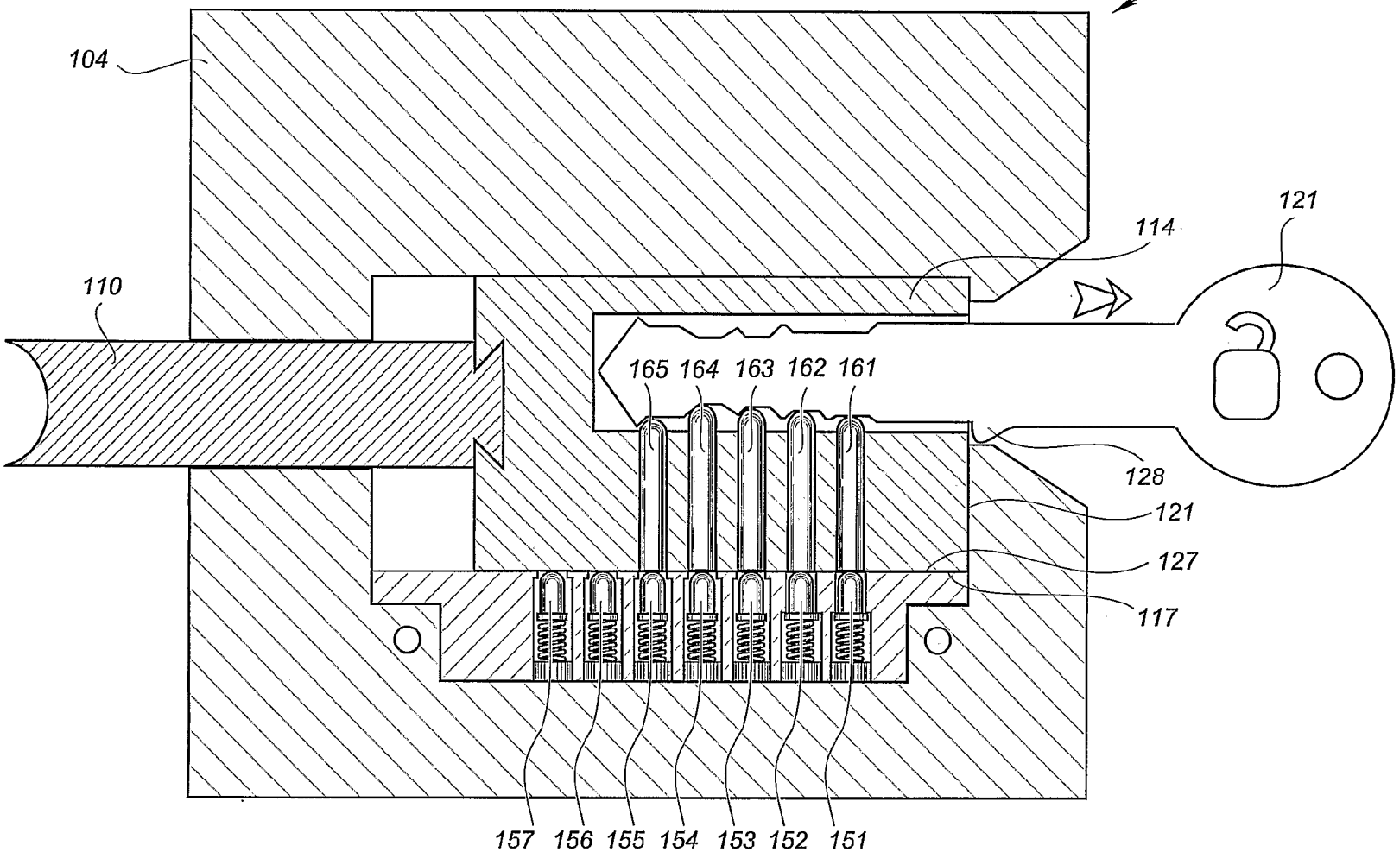
Figure 5D:
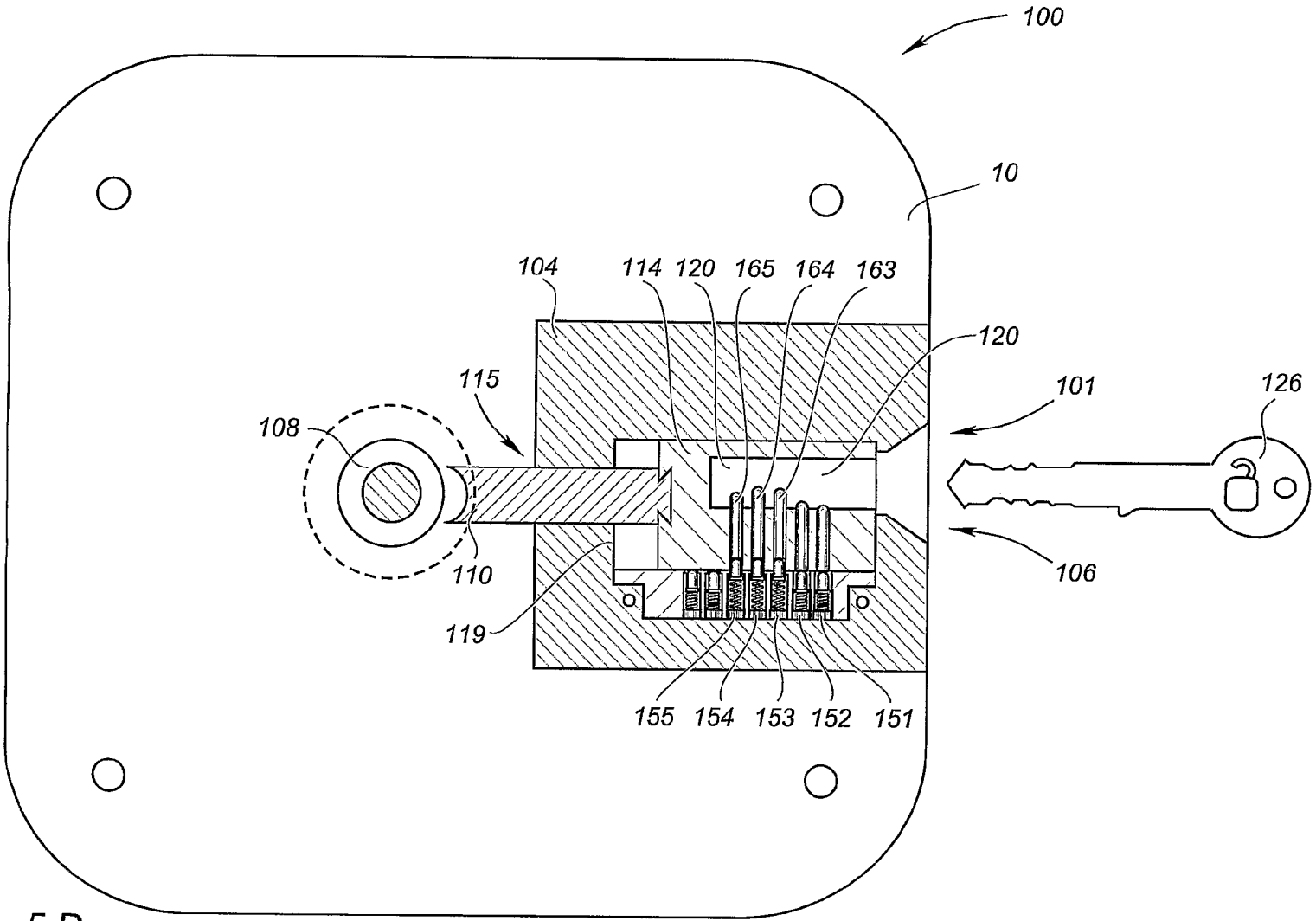

FIG. 5B shows locking mechanism 101 in the closed position, with key 126 fully inserted in key slot 120. Driver pins 161-165 are positioned into alignment with shear-line surface 117 by their respective notches 130. All key pins 151-157 are aligned with shear-line surface 117. By just pulling the key out, core 114 will follow-suit, sliding along shear-line surface 117 while key pins 151-157 and driver pins 161-165 remain aligned with shear-line surface 117 (no relative movement between the Key 126 and the core 114 due to friction against the driver pins). Fully extracting the Key will result the resuming of the open position as shown in FIG. 5D.

Figure 6:
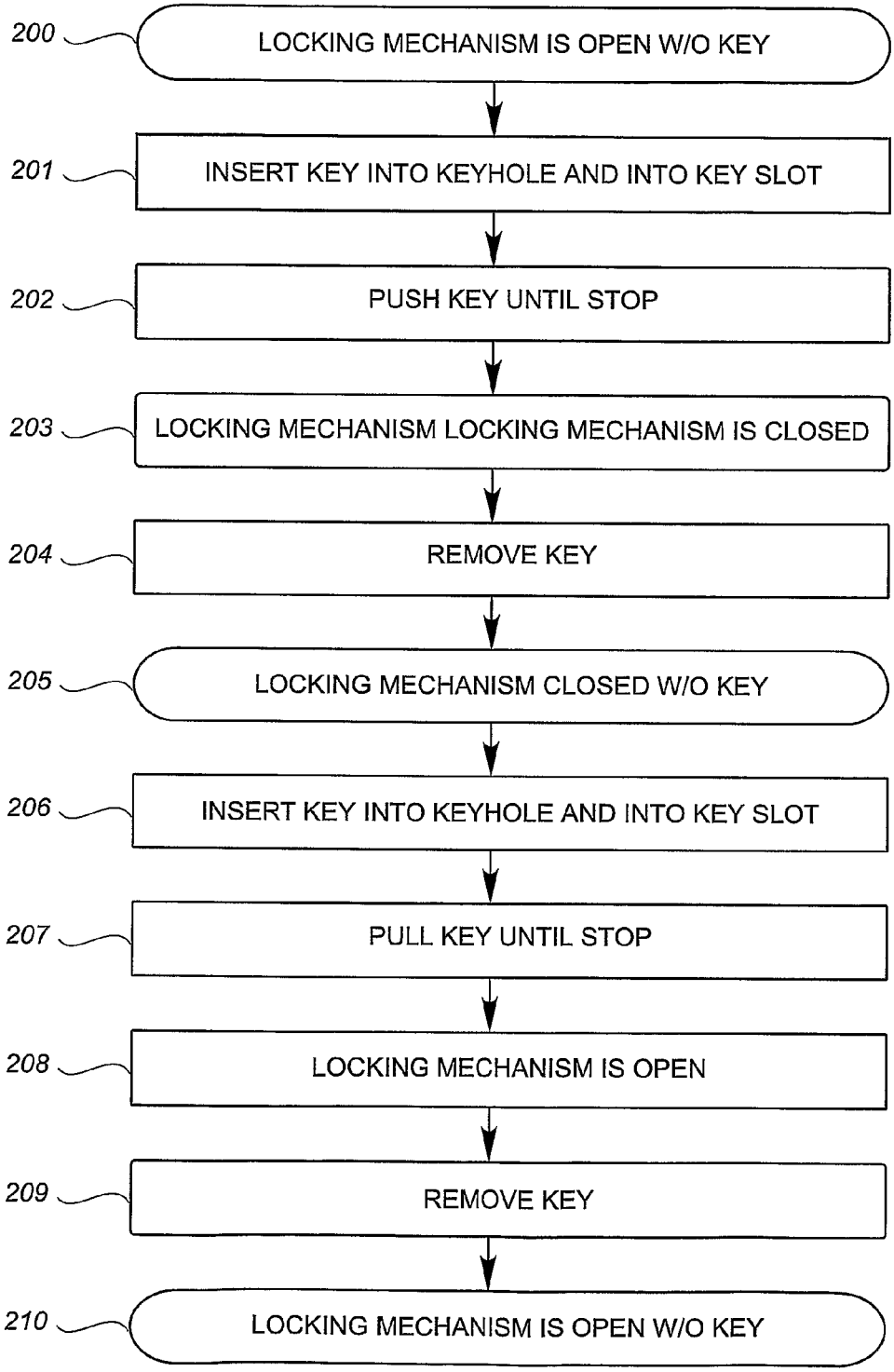
FIG. 6 schematically illustrates a flow diagram of an exemplary method of closing and opening the locking mechanism according to a preferred embodiment of the present invention.

Reference is now made to FIG. 6 which schematically illustrates a flow diagram of an exemplary method of closing and opening locking mechanism 101, according to a preferred embodiment. Reference is also made to FIGS. 1, 2, 3A-3F, 5, and 5A-5D in describing the method. The exemplary method described herein is not intended to be limiting in any way, form or manner, and it should be evident to a person skilled in the art that variations may exist in the implementation of the method.

STEP 200: Locking mechanism 101 is open (unlocked); core 114 is in the open position, abutting front wall 121. First series key-pin holes 151H-155H are aligned with first series driver-pin holes 161H-165*h* in core 114. Key pins 153-155 in the key-pin holes project into the driver-pin holes. Core 114 is locked in the open position by key pins 153-155 in the driver-pin holes 163H-165H. Key pins 151-155 push driver pins 161-165 so that the driver pins extend into key slot 120.

STEP 201: Key 126 is inserted through keyhole 106 into key slot 120 until knob 128 abuts with a front section of core 114. Driver pins 161-165 are pushed down by teeth 131 in key 126, and their alignment position with shear-line surface 117 secured by notches 132 on the key. Driver pins 161-165 push on five key pins 151-155, key pins 153-155 retracting in key-pin holes 153H-155H until aligned with shear-line surface 117. Key pin 151 and 152 are also aligned with shear-line surface 117.

STEP 202: Key 126 is pushed so that core 114 slides inside chamber 118 along shear-line surface from front wall 121 until abutting with rear wall 119 (closed position). Bar 110 extends outwards from chamber 118 through slot 115 in rear wall 119, for securing locking bolt 108.

STEP 203: Second series key-pin holes 153H-157H align with driver-pin holes 161-165. Key pin 153 projects into driver-pin hole 163H pushing driver pin 163 to abut with slot 132 in key 126. Core 114 is maintained stationary by key pin 153 for removal of key 126.

STEP 204: Key 126 is withdrawn from key slot 120.

STEP 205: Second series key-pins 153-157 project into driver-pin holes 161H-165H. Driver pins 161-165 are pushed into key slot 120 as there is no resistance from removed key 126. Core 114 is in the closed position and locking mechanism 101 is locked.

STEP 206: Key 126 is inverted and inserted through keyhole 106 into key slot 120. Driver pins 161-165 are pushed down by teeth 133 in key 126, and their alignment position with shear-line surface 117 secured by notches 130 on the key. Driver pins 161-165 push on key pins 153-157 so that they retract into key-pin holes 153H-157H until aligning with shear-line surface 117.

STEP 207: Key 126 is pulled so that core 114 slides inside chamber 118 along shear-line surface 117 from rear wall 119 until abutting with front wall 121 (open position). Bar 110 is pulled into chamber 118 through slot 115 in rear wall 119, releasing locking button 108.

STEP 208: First series key-pin holes 151H-155H align with driver-pin holes 161H-165H. Core 114 is maintained stationary in the open position by the abutment with front wall 121 for key 126 to be removed.

STEP 209: Key 126 is withdrawn from key slot 120.

STEP 210: Locking mechanism 101 is open (unlocked); core 114 is in the open position, abutting front wall 121. First key-pin holes 151H-155H are aligned with driver-pin holes 161H-165H in core 114, key pins 153-155 in key-pin holes 153*h*-155*h* extend into the driver-pin holes. Core 114 is locked in the open position by key pins 153-155 in driver-pin holes 163H-165H. Key pins 151-155 push driver pins 161-165 so that an end of each driver pin extends into key slot 120.

Those skilled in the art to which this invention pertains will readily appreciate that numerous changes, variations and modifications can effectuated without departing from the true spirit and scope of the invention as defined in and by the appendent claims.

What is claimed is:

1. A pin-tumbler locking mechanism comprising:

a lock-core with an elongated key slot and a series of bores arranged in a plane of the key slot;

a corresponding first series of driver pins of various lengths slidably received in the bores;

a lock-core casing movably supporting the lock-core, the interface between the lock-core and the lock-core casing defining a planar surface;

a first series of spring-supported key pins seated in a series of bores coaxially with the said driver pins so that normally at least some of the key pins extend beyond the planar surface, being in contact and adapted to push the driver pins to project into the key slot each by a different extent according to the respective lengths thereof, thereby preventing movement of the lock-core relative to the lock-core casing;

a key comprising on a first side a first series of teeth and notches for engaging the first series of driver pins, the key being configured so that when inserted into the key slot in a first orientation, the driver pin ends contacting the key pins become flushed with the planar surface to allow said movement of the lock-core to a core locked position, and the key comprising a second series of teeth and notches on an opposed side of the key and configured and shaped differently than the first series of teeth and notches, and further configured such that when the key is inserted into the key slot in an inverted orientation, the second series of teeth and notches engage the first series of driver pins to allow movement of the lock-core to an unlocked position, the first series of teeth and notches being incapable of releasing the lock-core to move from the locked position to the unlocked position; and wherein said movement is a sliding movement.

2. The mechanism as claimed in claim 1, wherein locking of the lock-core is attained by sliding the lock-core by the key a pre-set distance in a first inward direction, and withdrawing the key from the key slot in the locked position in such manner that the lock-core is prevented from moving to the unlocked position.

3. The mechanism as claimed in claim 2, wherein there are provided a second series of key pins in line with the said first series of key pins, whereby in the said locked position at least some of the said first series of driver pins become aligned with the key pins of the second series.

4. The mechanism as claimed in claim 3, wherein ends of the said first series of driver pins are pushed into the key slot by the second series of key pins when the key is withdrawn from the key slot.

5. The mechanism as claimed in claim 1, further comprising means associated with at least one, first in line, of the first series of the key pins for preventing the projection thereof beyond said planar surface.

6. The mechanism as claimed in claim 5, wherein said at least one key pin comprises a single key pin.

7. The mechanism as claimed in claim 5, including a second in line key pin of the said first series of the key pins.

8. The mechanism as claimed in claim 7, wherein a first in line tooth of the second series of teeth is removed.

9. The mechanism as claimed in claim 1, wherein the lock-core is coupled to a bar for applying a reciprocal locking and unlocking movement to a locking device.

10. A locking device for a door or a gate, the locking device comprising:

a pin-tumbler locking mechanism comprising a lock-core with an elongated key slot and a series of bores arranged in a plane of the key slot; a corresponding series of driver pins of various lengths slidably received in the bores; a lock-core casing movably supporting the lock-core, the interface between the lock-core and the lock-core casing defining a planar surface; a corresponding series of spring-supported key pins seated in a series of bores coaxially with the said driver pins so that normally at least some of the key pins extend beyond the planar surface, being in contact and adapted to push the driver pins to project into the key slot each by a different extent according to the respective lengths thereof; a key comprising first and second series of teeth and notches, on opposed sides of the key and so configured that when inserted into the key slot the driver pin ends contacting the key pins become flushed with the planar surface to allow said movement of the lock-core in inward and outward directions based on the key orientation inside the key slot; and wherein the lock-core is of a prismatic shape and said movement is a sliding movement.

* * * * *